US010033100B1

(12) United States Patent
Chayat et al.

(10) Patent No.: US 10,033,100 B1
(45) Date of Patent: Jul. 24, 2018

(54) FLOATING DIPOLE ANTENNA WITH RECESS EXCITATION

(71) Applicant: VAYYAR IMAGING LTD., Yehud (IL)

(72) Inventors: Naftali Chayat, Kfar Saba (IL); Doron Cohen, Tel Aviv (IL)

(73) Assignee: VAYYAR IMAGING LTD., Yehud (IL)

( * ) Notice: Subject to any disclaimer, the term of this patent is extended or adjusted under 35 U.S.C. 154(b) by 0 days.

(21) Appl. No.: 15/723,223

(22) Filed: Oct. 3, 2017

(51) Int. Cl.

| | |
|---|---|
| ***H01Q 5/30*** | (2015.01) |
| ***H01Q 9/28*** | (2006.01) |
| ***H01Q 9/04*** | (2006.01) |
| ***H01Q 9/06*** | (2006.01) |
| ***H01Q 9/40*** | (2006.01) |
| ***H01Q 1/38*** | (2006.01) |

(52) U.S. Cl.
CPC ..... *H01Q 5/30* (2015.01); *H01Q 1/38* (2013.01); *H01Q 9/0414* (2013.01); *H01Q 9/065* (2013.01); *H01Q 9/285* (2013.01); *H01Q 9/40* (2013.01)

(58) Field of Classification Search
CPC ..... H01Q 5/30; H01Q 1/38; H01Q 9/0414; H01Q 9/065; H01Q 9/285; H01Q 9/40
USPC ..... 342/175
See application file for complete search history.

(56) References Cited

U.S. PATENT DOCUMENTS

| | | | | |
|---|---|---|---|---|
| 5,872,545 | A * | 2/1999 | Rammos | H01Q 21/0075 343/700 MS |
| 8,358,247 | B2 * | 1/2013 | Chiu | H01Q 5/371 343/700 MS |
| 8,410,982 | B2 * | 4/2013 | Yung | H01Q 7/00 343/700 MS |
| 2006/0038724 | A1 * | 2/2006 | Tikhov | H01Q 1/248 343/700 MS |
| 2010/0201578 | A1 * | 8/2010 | Parsche | H01Q 1/242 343/700 MS |
| 2011/0074645 | A1 * | 3/2011 | Rietzler | G06K 19/07749 343/795 |

* cited by examiner

*Primary Examiner* — Frank J McGue
(74) *Attorney, Agent, or Firm* — Mark Cohen; Pearl Cohen; Zedek Latzer Baratz

(57) ABSTRACT

A compact wideband RF antenna for placement in a ground-plane recess at the edge of a printed circuit board. Wideband performance is enhanced by an electrically-isolated floating dipole, which electromagnetically couples signal excitation in the recess to a loop dipole formed from the ground-plane. The loop dipole connects to RF circuitry for transmission and reception. Antennas according to embodiments of the invention are capable of UWB operation in the 3.1-10.6 GHz band.

13 Claims, 9 Drawing Sheets

(bottom view)

FLOATING DIPOLE ANTENNA WITH RECESS EXCITATION

FIELD

The present invention relates to radio frequency antennas situated at an edge of a printed circuit board or a similar substrate. Such antennas are applicable to communications, radar and direction finding, and microwave imaging technologies.

BACKGROUND

Antennas are a critical component in communications, radar and direction finding systems, interfacing between the RF circuitry and the environment. RF circuitry is often manufactured using printed circuit board (PCB) technology, and numerous engineering and commercial advantages are realized by integrating the RF antennas directly on the same printed circuit boards as the circuitry. Doing so improves product quality, reliability, and form-factor compactness, while at the same time lowering manufacturing costs by eliminating fabrication steps, connectors, and mechanical supports.

There is a variety of PCB antennas, including microstrip patch antennas that radiate perpendicularly to the PCB, and printed Vivaldi and Yagi antennas that radiate parallel to the surface of the PCB. These antennas have dimensions on the order of the half-wavelength of the operating frequency, and at lower frequencies consume considerable PCB area.

A popular PCB edge-mountable antenna is the 'inverted-F' antenna. The antenna forms a quarter-wave resonator, with the transmission line parallel to the card edge, and having the shorting stem as the primary radiating element. The inverted-F antenna is smaller and more compact than a simple monopole antenna, and can be easily impedance-matched without additional components simply by proper positioning of the feed stem relative to that of the shorting stem.

Because of close proximity to the ground plane, however, PCB RF antennas typically have a narrow-band resonance, which is disadvantageous when wideband performance is needed, such as for ultra-wideband (UWB) operation in the 3.1-10.6 GHz band.

Thus, it would be desirable to have a compact profile PCB-edge antenna with improved wide-band matching characteristics. This goal is met by embodiments of the present invention.

SUMMARY

Embodiments of the present invention provide narrow-profile card-edge RF antennas with improved bandwidth characteristics, including antennas capable of UWB operation in the 3.1-10.6 GHz band.

Various embodiments of the present invention feature an RF antenna having an electrically-insulated conductive dipole within a recess of the ground-plane along an edge of the PCB. The term "recess" herein denotes a region where the ground-plane is absent, and where the insulating substrate of the PCB is exposed. The electrically-insulated conductive dipole serves as the primary radiating/receiving element of the antenna. Such an electrically-insulated conductive dipole is referred to herein as a "floating dipole", where the term "floating" denotes that the dipole has no direct electrical connection to any circuitry, including the circuitry serving as the source of the RF energy which the floating dipole radiates. That is, the floating dipole is electrically isolated, being insulated by the PCB insulating substrate both from the RF circuitry as well as from the ground plane. In this context, the excitation of the floating dipole is herein referred to as "recess excitation", denoting that the excitation of the floating dipole is provided by electromagnetic coupling to RF energy within the ground-plane recess, which originates from a separate loop dipole formed from the ground plane and driven by the RF circuitry. According to certain embodiments of the present invention, the floating dipole is located in the recess at a position closer to the PCB edge than the loop dipole.

It should be understood and appreciated that antenna embodiments according to the present invention include both transmission and reception capabilities. In descriptions herein where excitation of the antenna for transmission is detailed, it is understood that this is non-limiting, and that the same antenna is also capable of reception. Likewise, in discussions where reception is detailed, the same antenna is also capable of transmission. In particular, various embodiments of the present invention are suitable for use in Radar, where a single antenna handles both transmission and reception of signals.

Therefore, according to an embodiment of the present invention, there is provided a radio-frequency (RF) antenna for a printed circuit board (PCB), the antenna comprising: (a) a recess in a ground-plane of the PCB, wherein the recess is situated proximate to an edge of the PCB; (b) a loop dipole in the recess, wherein the loop dipole has two arms formed from the ground-plane and projecting into the recess; and (c) an electrically-isolated floating dipole in the recess, wherein the floating dipole is electrically-insulated by a substrate of the PCB; (d) wherein the floating dipole is electromagnetically coupled to the loop dipole by electromagnetic excitation in the recess.

BRIEF DESCRIPTION OF THE DRAWINGS

The subject matter disclosed may best be understood by reference to the following detailed description when read with the accompanying drawings in which.

Figure 1A:
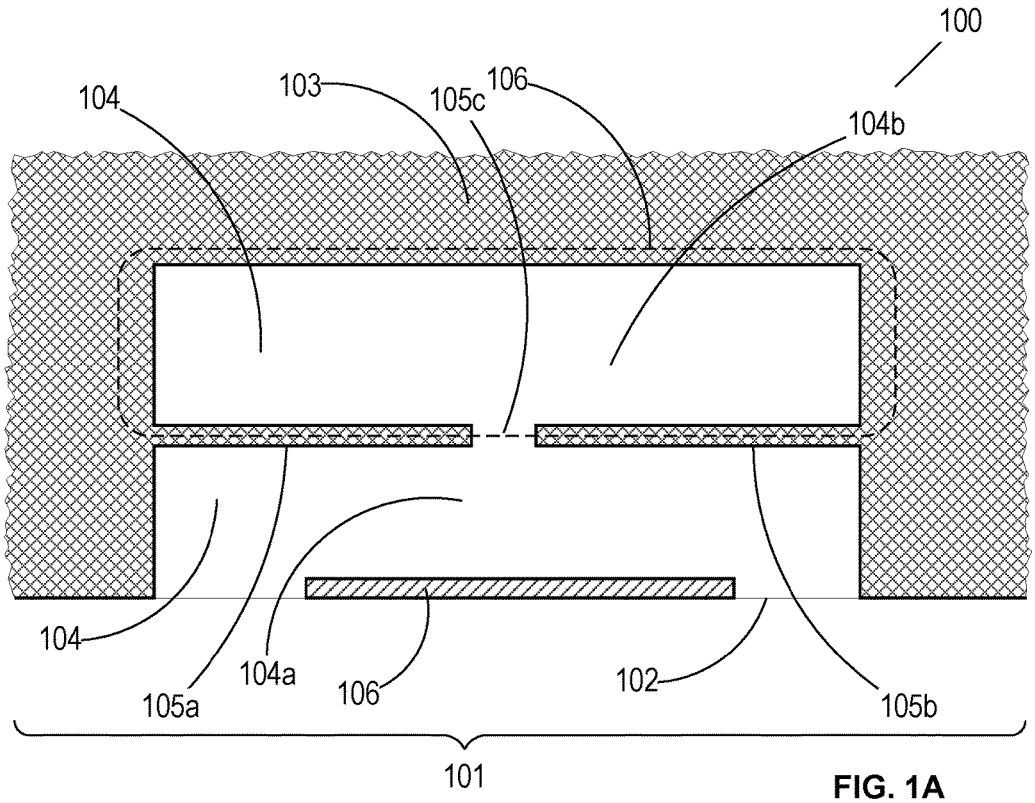
FIG. 1A is a plan view of an RF antenna at the edge of a PCB, according to an embodiment of the present invention.

For simplicity and clarity of illustration, elements shown in the figures are not necessarily drawn to scale, and the dimensions of some elements may be exaggerated relative to other elements. In addition, reference numerals may be repeated among the figures to indicate corresponding or analogous elements.

DETAILED DESCRIPTION

FIG. 1A is a plan view of an RF antenna 100 at a PCB edge 101, according to an embodiment of the present invention. The PCB has an insulating substrate 102 and a conductive ground-plane 103 with a recess 104. That is, ground-plane 103 does not extend into the areas of recess 104. A loop dipole having arms 105*a* and 105*b* divides recess 104 into an outer area 104*a* and an inner area 104*b*, both of which are considered to be parts of recess 104. A closed path 106 conceptually indicates the current path for loop dipole 105*a*-105*b*, including the displacement current flowing in a gap 105*c*. The term "gap" herein denotes a physical separation between loop dipole arms 105*a* and 105*b*, such that the arms do not contact one another. Non-limiting examples of a gap include horizontal separations as illustrated in the drawings, as well as vertical separations, such as the case where loop dipole arms 105*a* and 105*b* are in different PCB layers, including horizontally-overlapping layers. In any case, where loop dipole arms 105*a* and 105*b* do not physically touch, there is understood to be a gap between them. Loop dipole 105*a*-105*b* is driven by RF circuitry (not shown) in various ways according to additional embodiments of the invention, as described herein.

An electrically-conductive floating dipole 106 is located proximate to PCB edge 101 on substrate 102 in outer region 104*a* of recess 104. As described previously, floating dipole 106 is isolated from other electrically-conductive elements by insulating substrate 102.

According to these embodiments, the floating dipole is located within a recess of a PCB ground-plane proximate to an edge of the PCB, and is electromagnetically-coupled to a loop dipole formed of the ground-plane. In transmission mode, the RF circuitry on the PCB directly drives the loop dipole, in turn exciting the floating dipole, which then radiates the RF energy.

Figure 1B:
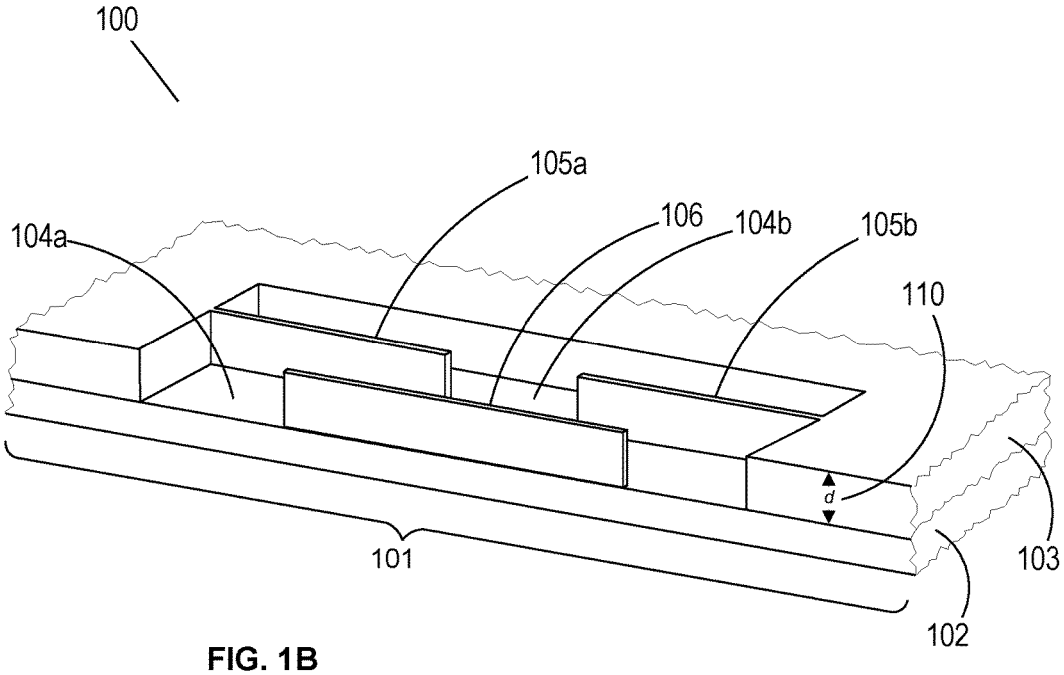
FIG. 1B is an isometric view of the RF antenna of FIG. 1A.

FIG. 1B is an isometric view of RF antenna 100. The isometric view indicates that ground plane 103 and floating dipole 106 have a thickness d. In general, the thickness d is determined by the PCB manufacturing process, with typical values being 0.7-1.4 mil (approximately 20-40 microns). Accordingly, the thickness d of the metal layer 103 in FIG. 1B is exaggerated relative to the typical thickness of the dielectric substrate 102, typical values being 0.8-1.6 mm.

Figure 2A:
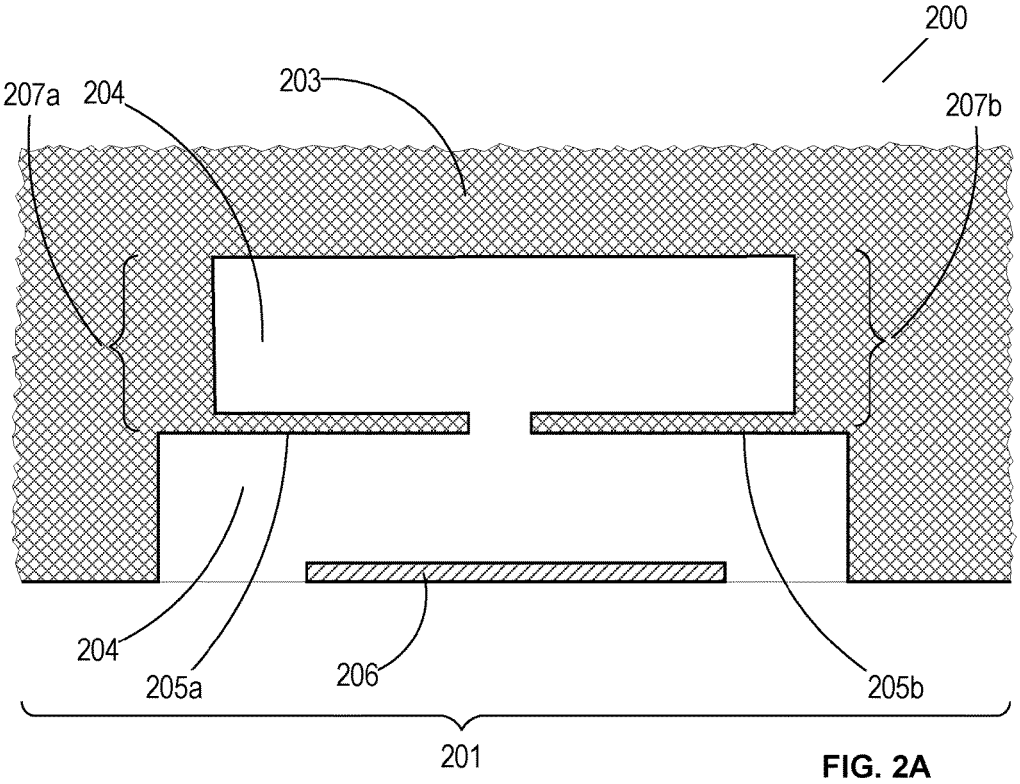
FIG. 2A is a plan view of an RF antenna at the edge of a PCB, according to another embodiment of the present invention, which utilizes 'inverted L' elements in the loop dipole.
Figure 2B:
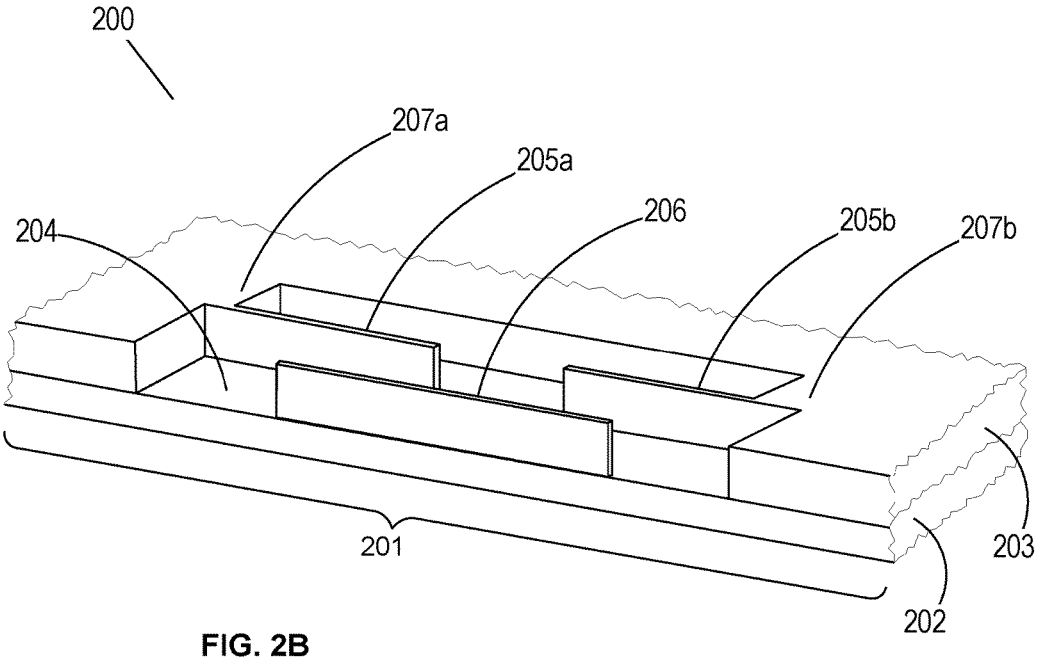
FIG. 2B is an isometric view of the RF antenna of FIG. 2A.

FIG. 2A is a plan view of an RF antenna 200 at a PCB edge 201, according to another embodiment of the present invention. The PCB has an insulating substrate 202 and a conductive ground-plane 203 with a recess 204. A loop dipole having arms 205*a* and 205*b* provides RF excitation in recess 204, which couples electromagnetically to a floating dipole 206. In this embodiment, loop dipole arm 205*a* is an L-shaped element having a section 207*a*, and loop dipole arm 205*b* is an L-shaped element having a section 207*b*.

Figure 3A:
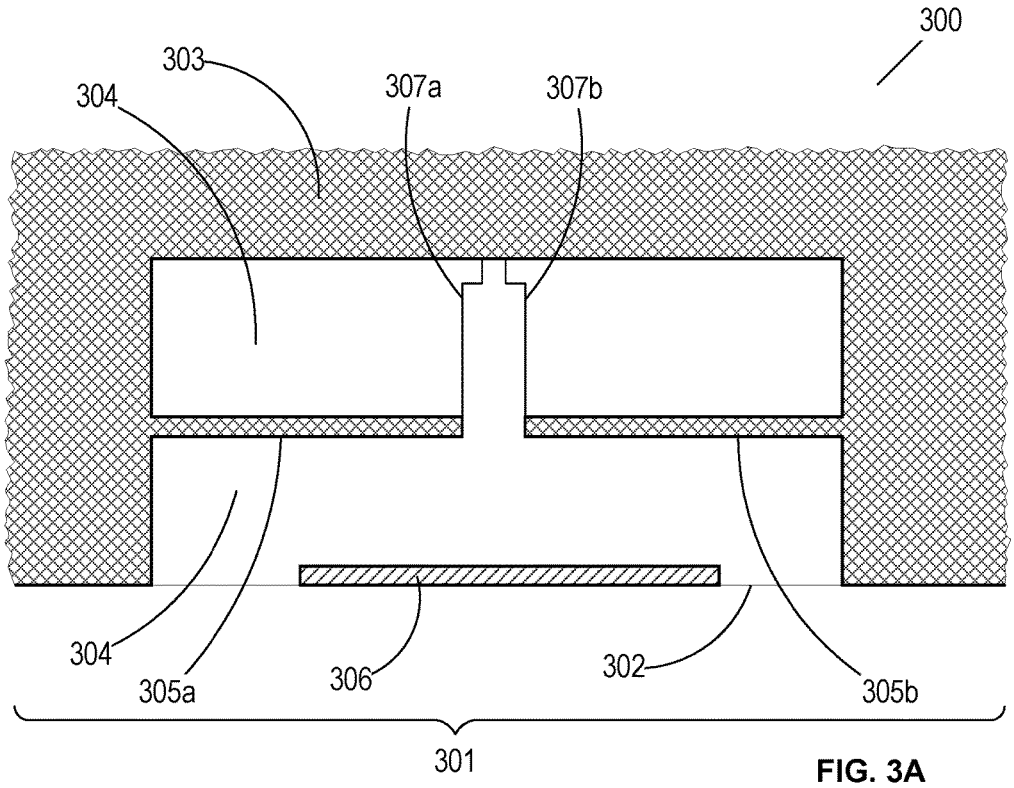
FIG. 3A is a plan view of an RF antenna at the edge of a PCB, according to a further embodiment of the present invention, which provides for a thin ground-plane comparable to a printed ground-plane, and for center-feeding of the loop dipole.

FIG. 3A is a plan view of an RF antenna 300 at a PCB edge 301, according to a further embodiment of the present invention. The PCB has an insulating substrate 302 and a conductive ground-plane 303 with a recess 304. A loop dipole having arms 305*a* and 305*b* provides RF transmission excitation in recess 304, which couples electromagnetically to a floating dipole 306. In yet another embodiment, loop dipole arms 305*a* and 305*b* are electrically driven by antenna feed connections 307*a* and 307*b*, respectively, which are driven by differential signals. Antenna feed connections 307*a*-307*b* couple loop dipole 305*a*-305*b* to RF circuitry (not shown), for transmission and reception. In a related embodiment, antenna feed connections 307*a* and 307*b* are made to the ends of loop dipole arms 305*a* and 305*b*, as shown in FIG. 3A.

Figure 3B:
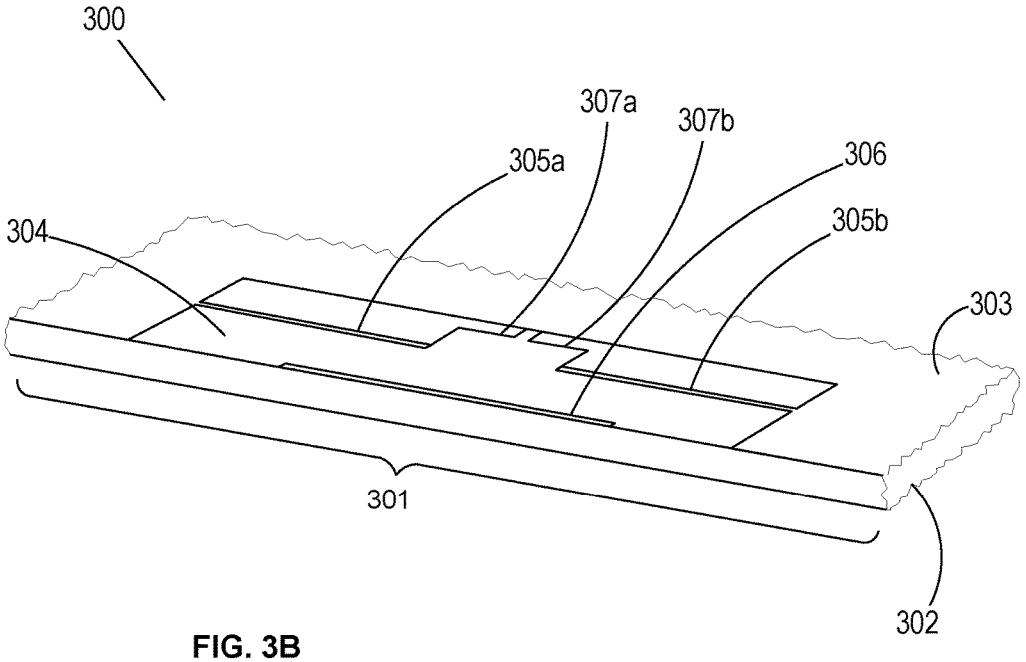
FIG. 3B is an isometric view of the RF antenna of FIG. 3A.

FIG. 3B is an isometric view of antenna 300. The isometric view indicates that in this embodiment, ground plane 303 and floating dipole 306 have a thickness substantially that of a typical PCB plating.

Figure 4A:
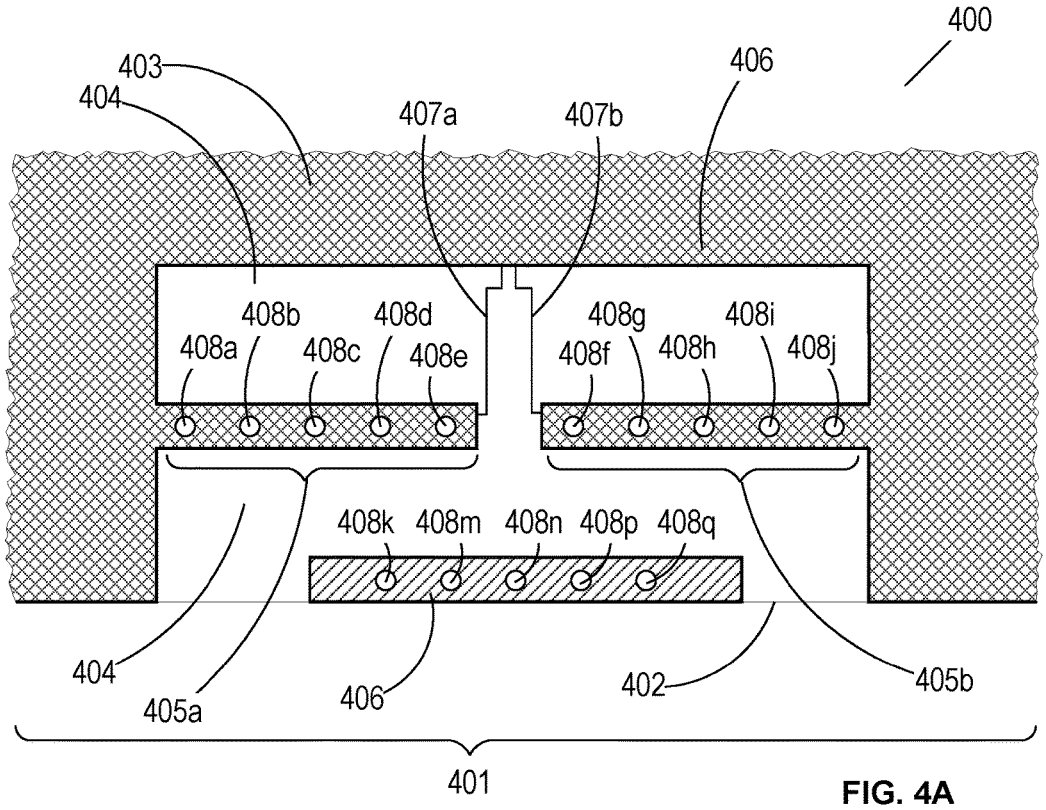
FIG. 4A is a plan view of an RF antenna at the edge of a PCB, according to an additional embodiment of the present invention, which provides for dipoles in multiple PCB layers interconnected by via fences.

FIG. 4A is a plan view of an RF antenna 400 at a PCB edge 401, according to an additional embodiment of the present invention, which provides for loop dipole arms 405*a* and 405*b* in multiple PCB layers interconnected by via fences formed by vias 408*a*, 408*b*, 408*c*, 408*d*, and 408*e* in loop dipole arm 405*a*; and by vias 408*f*, 408*g*, 408*h*, 408*i*, and 408*j* in loop dipole arm 405*b*. Likewise, a floating dipole 406 is formed of multiple PCB layers 409*a*, 409*b*, 409*c*, 409*d*, 409*e*, and 409*f* interconnected by vias 408*k*, 408*m*, 408*n*, 408*p*, and 408*q*. Vias are metallized holes, sometimes filled with metal, to provide electrical conductivity between PCB layers. Use of multiple layers reduces the associated resistance and the energy losses in the surfaces. The vias, spaced closely enough, equalize the potential between the surfaces.

Figure 4B:
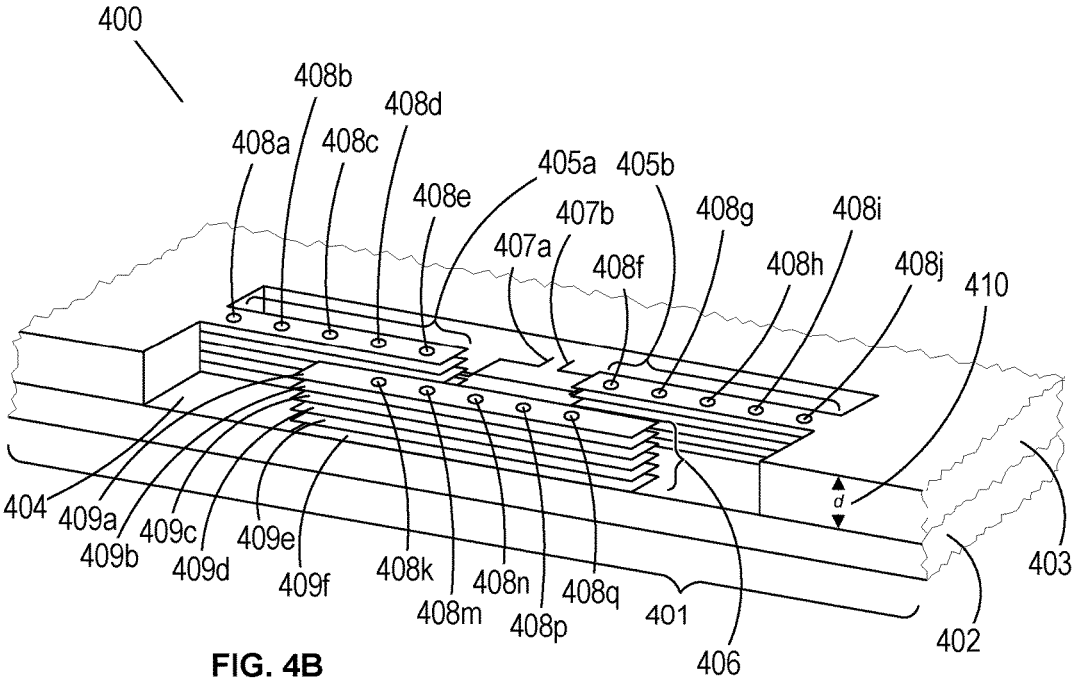
FIG. 4B is an isometric view of the RF antenna of FIG. 4A, additionally showing the multiple layers of the PCB.

FIG. 4B is an isometric view of antenna 400. The multiple PCB layers are positioned atop one another on insulating substrate 402 and collectively form ground plane 403 and loop dipole arms 405*a* and 405*b*. The arrays of vias 408*a*-408*e* and vias 408*f*-408*j* provide electrical connections between the multiple PCB layers, to approximate the effect of a solid conductor of thickness d 410.

It is understood that loop dipole arms 405*a* and 405*b* include the associated conducting traces of each of the PCB layers as well as the metallized vias. Likewise, floating dipole 406 includes the associated conducting traces of each of the PCB layers as well as the metallized vias.

Figure 5:
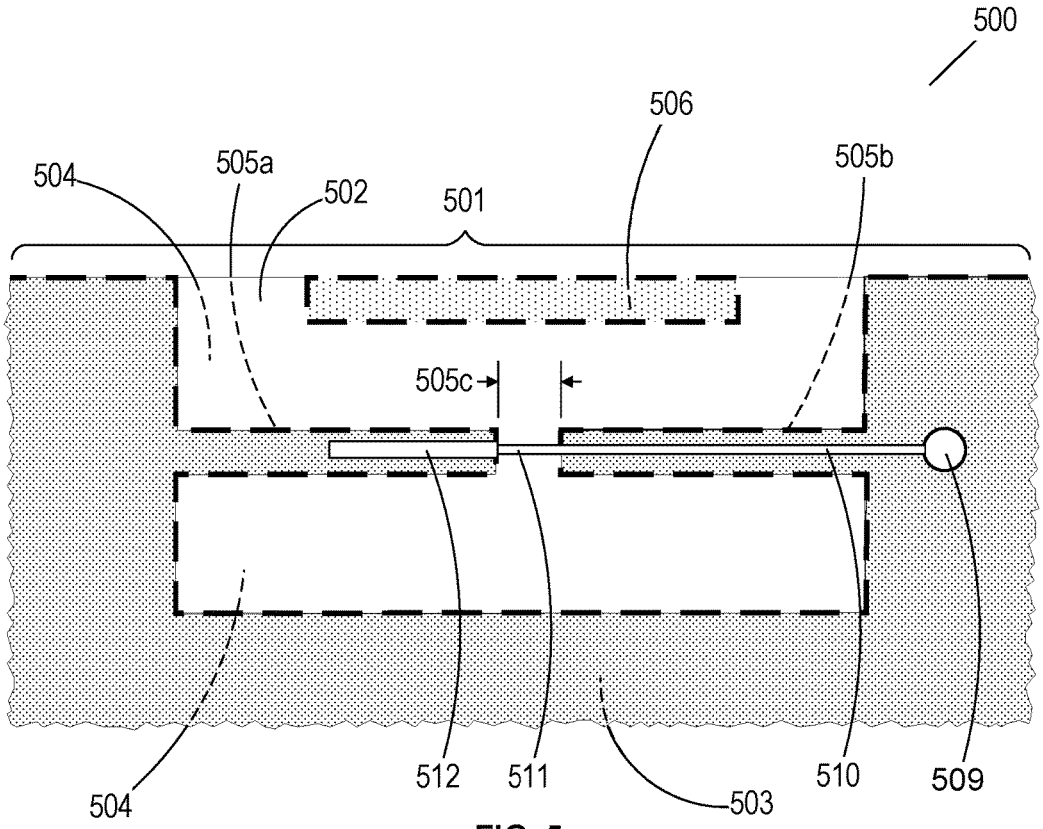
FIG. 5 is a plan view of the bottom of an RF antenna at the edge of a PCB, according to an additional embodiment of the present invention, which provides for capacitive feeding of the loop dipole.

FIG. 5 exemplifies another embodiment of feed mechanism for an illustrated antenna 500. The single-ended signal is applied at a drive point 509, and then it propagates along a transmission line 510 extending across arm 505*b* and crossing gap 505*c* to arm 505*a* (loop dipole arm 505*b* serves as a ground-plane for transmission line 510). Transmission line 510 has line section 511 that crosses gap 505*c* between loop dipole arms 505*a* and 505*b*. Transmission line 510 then further connects to a line section 512, for which for which loop dipole arm 505*a* serves as a ground-plane. In a related embodiment, line 512 is broader, so as to form a capacitive transmission line stub extending along arm 505*a*. In another related embodiment transmission line 510 is shorted to arm 505*a*. The combination of an antenna feed transmission line 510, crossing line 511 and stub line 512 form a "balun" (balanced-to-unbalanced) element that converts a single-ended signal to a differential antenna feed for the loop dipole.

The transmission lines can be either microstrip lines or stripline transmission lines. The microstrip technology is better suited for low-cost fabrication, where double sided PCB technology is used. The stripline technology is better suited to multilayer printed circuit boards, so that the top and bottom layers form "ground" surfaces, while middle layer caries the signal, as is graphically illustrated in FIG. 6.

Figure 6:
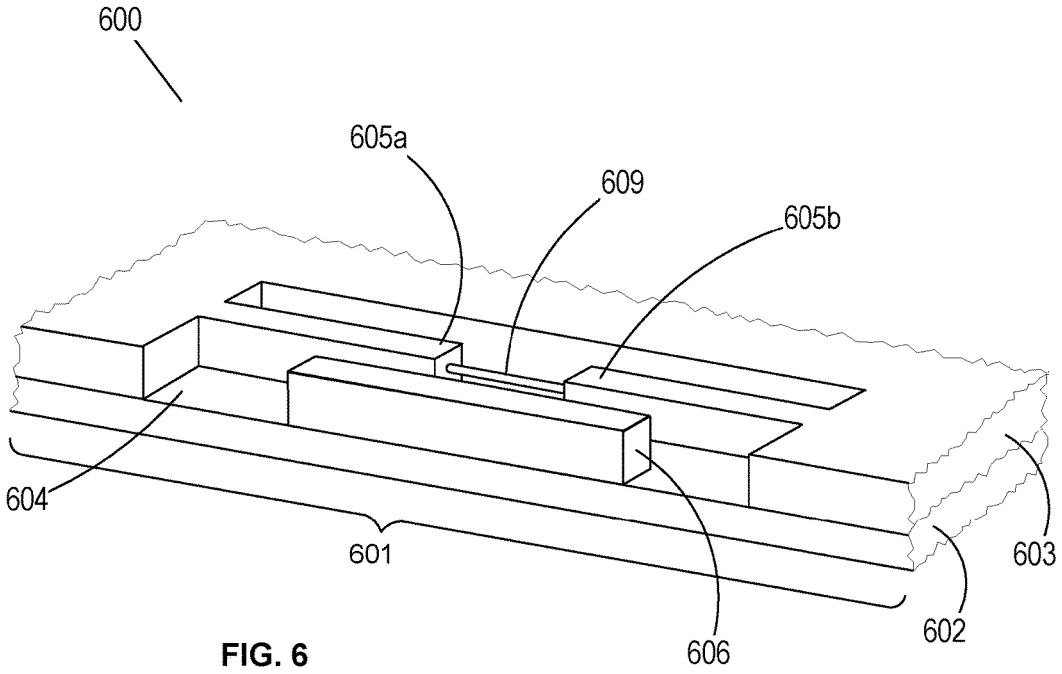
FIG. 6 is an isometric view of an RF antenna at the edge of a PCB, according other additional embodiments of the present invention, which provide coaxial and stripline feeding of the loop dipole.

FIG. 6 is an isometric view of an RF antenna 600 at a PCB edge 601, according to an embodiment of the present invention. The PCB has an insulating substrate 602 and a conductive ground-plane 603 with a recess 604 and a floating dipole 606. A loop dipole having arms 605*a* and 605*b* is fed by a coaxial line 609. In a related embodiment, connector 609 is a stripline. In another related embodiment connector 609 is a microstrip line.

According to certain embodiments of the invention, the recess width is typically on the order of a half-wavelength at the center of the band of interest, while the depth of the recess relates to the desired bandwidth. The floating dipole is somewhat shorter than a half-wavelength, due to loading by fringe capacitance of the ground-plane at the edges of the floating dipole. Similarly, the loop dipole is shorter than a half-wavelength due to the fringe capacitance between the edges of the loop dipole. The spacing between the loop dipole and the floating dipole determines the amount of coupling that eventually widens the matching bandwidth. In related embodiments, after selecting the preferred feed mechanism, the overall dimensions are optimized, while enforcing critical constraints, such as the recess depth.

Certain embodiments feature an exemplary design optimized for operation within the 6-8.5 GHz sub-band of the UWB frequency band of 3.1-10.6 GHz; this frequency sub-band is important because it is available throughout numerous regulatory regions. The optimization of the antenna design for a low-cost FR4 PCB and for recess dimensions of 18 mm width and 6 mm depth result in a floating dipole length of approximately 11 mm, slot dimensions of 2.5 mm×14 mm, and spacing of 2.5 mm between the loop dipole and the floating dipole. The resulting response has excellent match and stable end-fire radiation patterns across the 6-8.5 GHz band of interest, and good usable characteristics over a band from below 4 GHz to over 10 GHz.

APPLICATIONS

Embodiments of the present invention have numerous potential applications.

Figure 7:
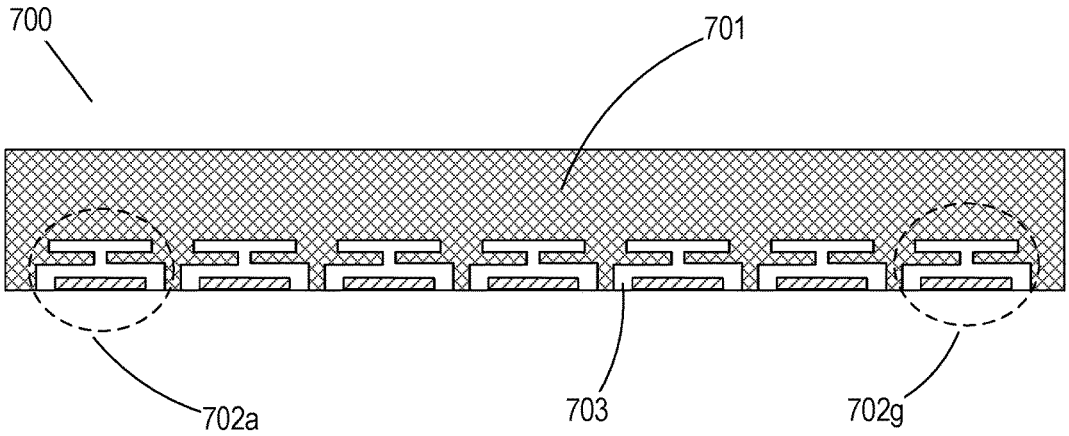
FIG. 7 illustrates an array of floating dipole antennas, according to an embodiment of the present invention.

One thing to note is that the antennas of present invention are easily combined into antenna arrays by placing multiple antennas along one or more edges of a PCB. FIG. 7 exemplifies such an array 700, in which a common substrate 703 and a common ground-plane 701 is used to host multiple antennas 702*a*-702*g*. The inner details of the antennas are omitted in FIG. 7 for clarity.

Figure 8:
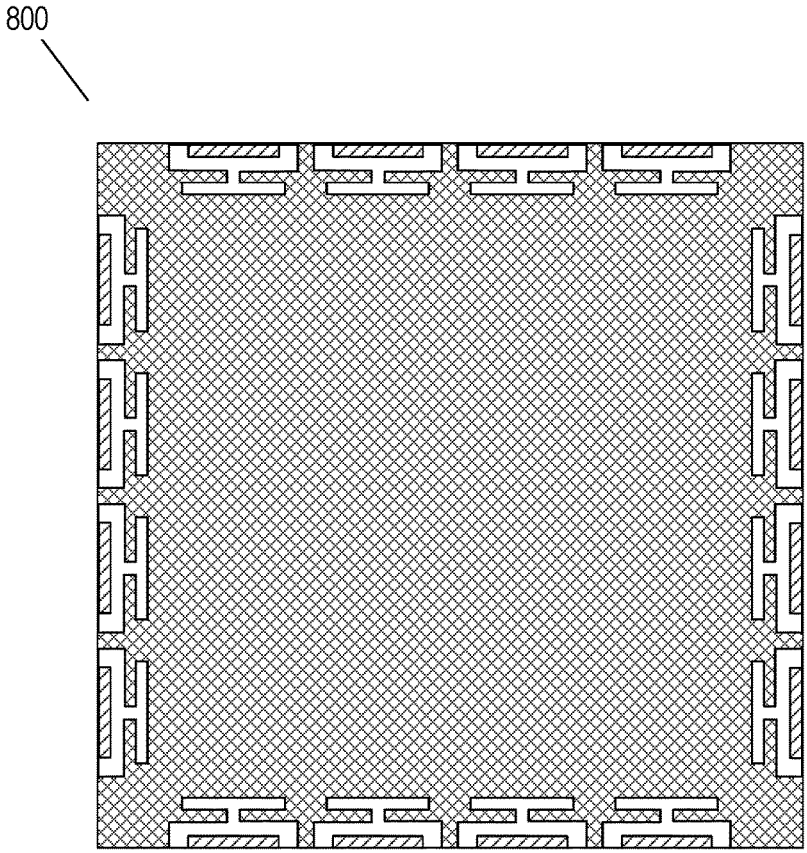
FIG. 8 illustrates arrays of floating dipole antennas on all sides of a PCB, according to an embodiment of the present invention.
Figure 9:
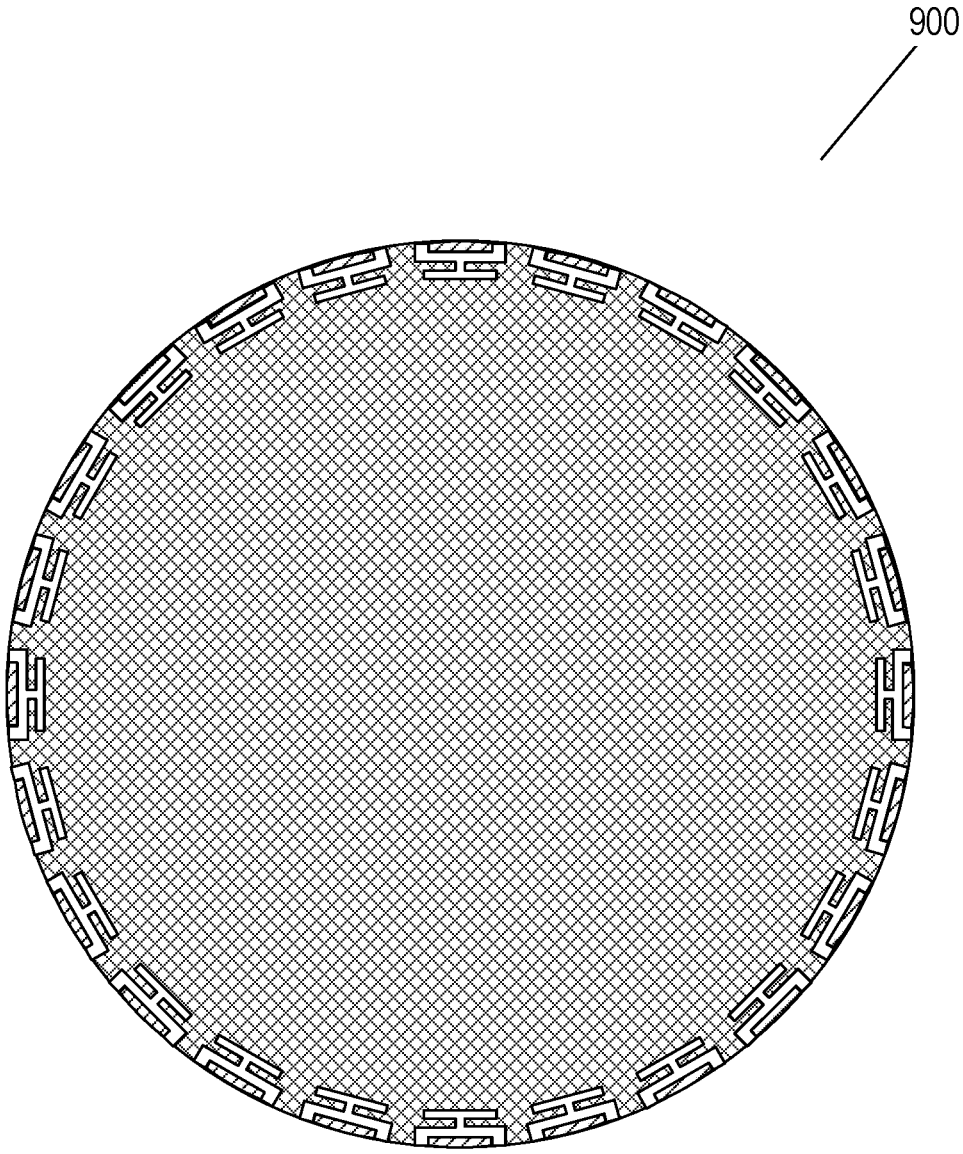
FIG. 9 illustrates a circular array of floating dipole antennas, according to an embodiment of the present invention.

One family of applications is achieving omnidirectional azimuthal coverage by using antennas azimuthally distributed around the edges of a horizontally placed PCB. The antennas can be driven separately, or in a phased array manner to achieve improved angular resolution. In an embodiment of the invention, a rectangular PCB is used, with an antenna or multiple antennas on each of the edges. This non-limiting example is exemplified in FIG. 8, where four groups of antennas are located along the four edges of a PCB 800. In a related embodiment, the array is circular or polygonal array, where each antenna faces a different direction, and the antennas are essentially equispaced in azimuth, as exemplified by a circular array 900 in FIG. 9. The use of circular antenna array creates more uniform performance in all directions. Uses of such arrays can be in a room (ceiling mounted or tabletop), for detecting activity at all directions with a radar. Omnidirectional arrays can be used on a vehicle rooftop or on a drone for obstacle detection. In a related embodiment, an azimuthally-distributed array is situated on a polygonal-shaped PCB. In another related embodiment, an azimuthally-distributed array is situated on a PCB having a shape with a rounded curve.

Figure 10:
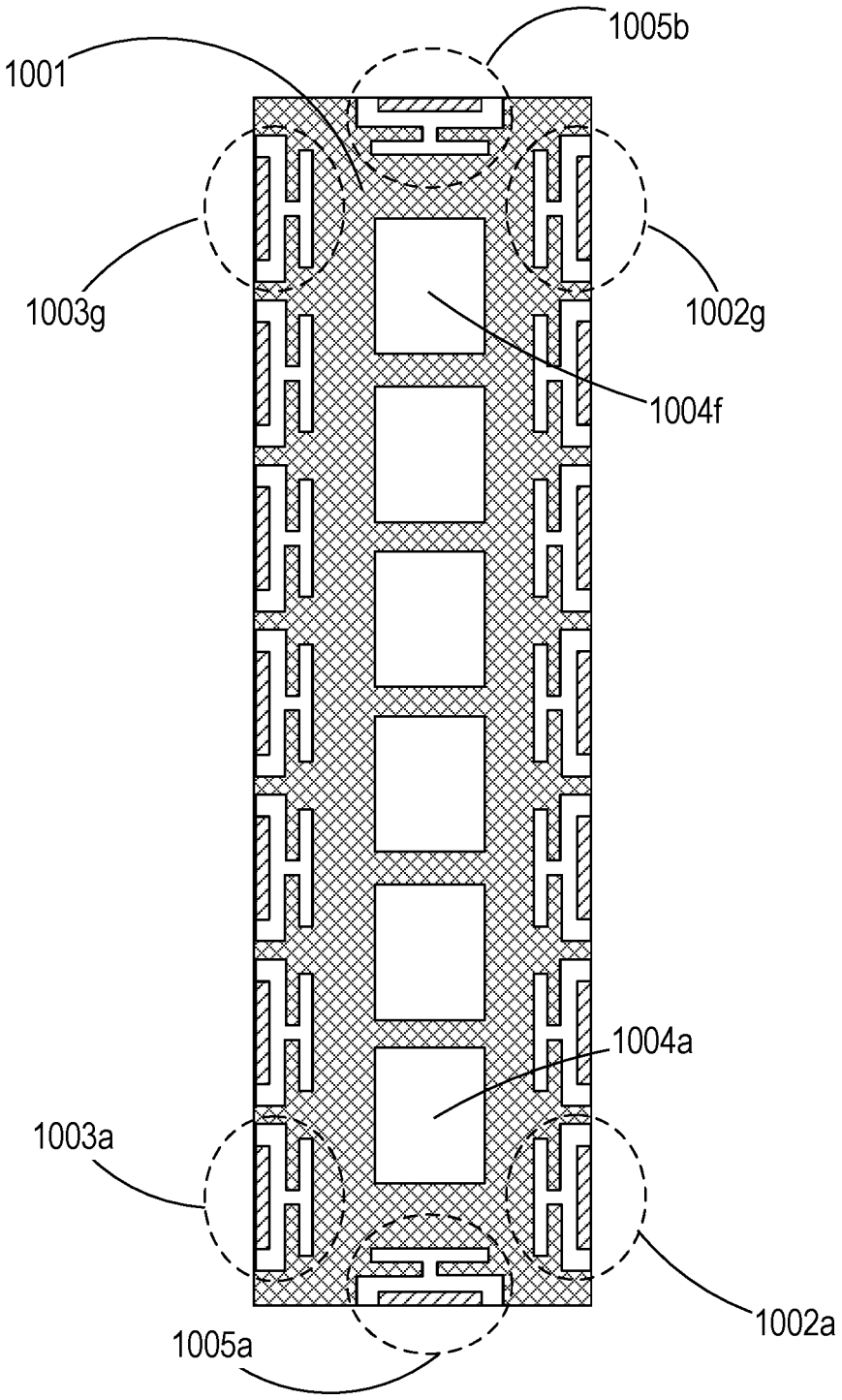
FIG. 10 illustrates a combination of arrays of floating dipole antennas having different directional orientations, according to an embodiment of the present invention.

Another use case of such antennas are in robots, such as robotic vacuum cleaners. Use of a robot-mounted radar can assist in navigation and in obstacle detection and classification. This case is exemplified in an embodiment shown in FIG. 10. A PCB 1001 is mounted vertically, so that the face of the PCB contains broadside forward-looking radar antennas 1004*a*-1004*f*, while downward looking antennas 1002*a*-1002*g* can detect obstacles on the floor, upward-looking antennas 1003*a*-1003*g* can detect the ceiling or overhead objects, and side-looking antennas 1005*a*-1005*b* can detect lateral obstacles.

Another application is placing antennas or antenna arrays, as exemplified by the embodiment illustrated in FIG. 7, in the wings (fixed or rotary) of aircraft, where the narrow profile helps maintain the aerodynamic shape of the wing. For example, placing forward-looking antennas in a fixed wing can create a high-resolution radar, while placement in a rotary wing can be used for SAR processing that utilizes the rotary motion of the wing. Such applications may suit small UAVs or drones.

Another application where the narrow profile of the antenna facing the radiation direction comes of help is placing the antennas along the periphery of (among other) appliances such as TV screens with a narrow rim or air conditioners, in order to detect by a radar activity of the people in the room and adjust the operation of the appliance accordingly (direct the flow of the air conditioner, dim the TV etc.).

What is claimed is:

1. A radio-frequency (RF) antenna for a printed circuit board (PCB), the antenna comprising:
   - a recess in a ground-plane of the PCB, wherein the recess is situated proximate to an edge of the PCB;
   - a loop dipole in the recess, wherein the loop dipole has two arms separated by a gap, wherein the arms are formed from the ground-plane and project into the recess;
   - at least one antenna feed connection coupled to the loop dipole; and
   - an electrically-isolated floating dipole in the recess, wherein the floating dipole is electrically-insulated by a substrate of the PCB;
   - wherein the floating dipole is electromagnetically coupled to the loop dipole.

2. The RF antenna of claim 1, wherein the loop dipole has L-shaped arms.

3. The RF antenna of claim 1, wherein the loop dipole is fed at the ends of the arms by end-feed connections.

4. The RF antenna of claim 1, wherein the loop dipole is fed by a transmission line extending along one of the loop dipole arms and crossing the gap between the loop dipole arms.

5. The RF antenna of claim 4, wherein the transmission line is selected from a group consisting of:

a coaxial line;

a stripline; and a microstrip line.

6. The RF antenna of claim 4, wherein the transmission line is shorted to the other of the loop dipole arms.

7. The RF antenna of claim 4, wherein the transmission line connects to a transmission line stub extending along the other of the loop dipole arms.

8. The RF antenna of claim 1, wherein:

the loop dipole is formed from a plurality of PCB layers which are electrically interconnected by at least one via; and the floating dipole is formed from a plurality of PCB layers which are electrically interconnected by at least one via.

9. An RF antenna array comprising a plurality of RF antennas according to claim 1.

10. The RF antenna array of claim 9, wherein the RF antennas of the plurality are situated on a common edge of the PCB.

11. The RF antenna array of claim 9, wherein the RF antennas of the plurality are situated on different edges of the PCB.

12. The RF antenna array of claim 9, wherein the RF antennas of the plurality are azimuthally distributed on the edges of the PCB.

13. The RF antenna array of claim 12, wherein the PCB has a shape is selected from a group consisting of:

a polygonal shape; and a rounded curve.

* * * * *